US005949037A

United States Patent [19]

Oya

[11] Patent Number: 5,949,037

[45] Date of Patent: Sep. 7, 1999

[54] ELEVATOR CALL REGISTRATION SYSTEM

[75] Inventor: Kyozo Oya, Aichi, Japan

[73] Assignee: Mitsubishi Denki Kabushiki Kaisha, Tokyo, Japan

[21] Appl. No.: 09/189,989

[22] Filed: Nov. 12, 1998

[30] Foreign Application Priority Data

Jun. 26, 1998 [JP] Japan ..... 10-180195

[51] Int. Cl.[6] ..... B66B 1/16; B66B 1/34

[52] U.S. Cl. ..... 187/392; 187/381; 187/384

[58] Field of Search ..... 187/392, 384, 187/381, 391, 395, 380

[56] References Cited

U.S. PATENT DOCUMENTS

| | | | |
|---|---|---|---|
| 4,558,298 | 12/1985 | Kawai et al. | 340/19 R |
| 4,915,197 | 4/1990 | Schroder | 187/381 |
| 4,979,594 | 12/1990 | Begle et al. | 187/380 |
| 5,689,094 | 11/1997 | Fredli et al. | 187/384 |

FOREIGN PATENT DOCUMENTS

| | | | |
|---|---|---|---|
| 2-81884 | 3/1990 | Japan | 187/381 |
| 4-286580 | 10/1992 | Japan | 187/381 |
| 5776 | 1/1993 | Japan . | |
| 61549 | 1/1994 | Japan . | |
| 6298476 | 10/1994 | Japan . | |

*Primary Examiner*—Robert E. Nappi
*Attorney, Agent, or Firm*—Leydig, Voit & Mayer, Ltd.

[57] ABSTRACT

There is described an elevator call registration system which enables automatic registration of a destination floor and correction of the thus-registered destination floor. A destination floor CC is anticipated for each passenger, and the thus-expected floor is stored in expected destination floor storage means. The passenger is identified by means of passenger identification means, and the expected destination floor MCC is read from the expected destination floor storage means on the basis of the result of such identification. For convenience of checking, the expected destination floor MCC is temporarily indicated in a car and is automatically registered in a control panel of the elevator as the final destination floor. If the destination floor CC intended by the passenger is different from the expected destination floor MCC, the destination floor CC based on the expected destination floor MCC can be corrected by new designation of the destination floor CC through use of a car destination button.

20 Claims, 13 Drawing Sheets

ELEVATOR CALL REGISTRATION SYSTEM

BACKGROUND OF THE INVENTION

1. Field of the Invention

The present invention related to an elevator call registration system.

2. Description of the Background Art

An invention related to elevator calls—such as an invention related to elevator calls being registered through use of individual identification means—is described in Japanese Patent Application Laid-open No. Hei-2-43185. In this invention, individual fingerprints are stored in a database beforehand, and every time the passenger uses the elevator the fingerprint of the passenger is detected. A call is registered only when the detected fingerprint matches with the fingerprint stored in the database, thereby preventing crime.

Further, an invention in which a fingerprint detection device is provided in an elevator car beforehand is described in Japanese Patent Application Laid-open No. Hei-5-776. The fingerprints of fingers of individuals are registered beforehand so as to correspond to a floor. Alternatively, a combination of the fingerprints of each of the individuals are registered beforehand so as to correspond to a floor. When the fingerprint detection device detects a registered fingerprint, the elevator car is operated to a corresponding floor as a destination. The call registration device enables both fingerprint verification and destination designation with a single operation. The system allows a plurality of destinations to be specified by means of a few fingerprint detection devices as well as ensuring crime prevention while providing simplifying operations.

A person who comes and goes within a building usually has a routine pattern of action or traffic line. For instance, a person living in a condominium chiefly travels back and forth between the lobby and the floor on which he lives. Even in an office building, in many cases, a person—who does not belong to any offices located in the building and cannot be identified and registered beforehand (hereinafter referred to simply as a "visitor")—takes a traffic line between the lobby and a destination within the building. Further, even a person—who belongs to one of the offices located in the building and can be identified and registered beforehand (hereinafter referred to simply as a "registered passenger")—travels back and forth between the lobby and the floor on which his office is located during the time when he goes to and leaves the office. During working hours, the person chiefly travels back and forth among office floors closely related to him. More specifically, traffic within a building inevitably corresponds to back-and-forth traveling actions. For this reason, in a case where an elevator is used as transit means for purposes of back-and-forth traveling actions, a return path is the reverse of the path to the destination and hence is inevitably determined. Further, as mentioned above, in most cases the path to the destination is usually routinely determined.

Although the person has a routine traffic line within a building, the traffic line differs from person to person. In order to process a fractional portion of the course of such diversified actions of each person by means of an elevator, there has been employed a method of requiring the passenger to designate a destination every time he uses the elevator. Even in the case of the elevator that uses the aforementioned fingerprint detection device, the fingerprint serves only as means for determining whether or not the passenger can use the elevator from the viewpoint of crime prevention. Accordingly, the passenger is required to individually specify a destination on his way to visit and on his way to leave, thus subjecting the passenger to inconvenience.

SUMMARY OF THE INVENTION

The present invention has been conceived to eliminate such inconvenience, and a general object of the present invention is to provide a novel and useful elevator call registration system.

A more specific object of the present invention is to provide an elevator call registration system which automatically registers a destination in consideration of the routine traffic line of an individual in a building.

Another object of the present invention is to provide an elevator system which enables automatic registration of a destination as much as possible even when a person follows a traffic line deviating from a routine traffic line.

Still another object of the present invention is to provide an elevator call system which enables to automatically register not only the persons belonging to offices located in a building but also visitors from the outside of the building, through the same manner.

The above objects of the present invention are achieved by an elevator call registration system. The elevator call registration system comprises: passenger identification means which is provided in an elevator hall and identifies a passenger; expected destination floor storage means for storing, as an expected destination floor of the passenger, a floor which is previously determined so as to correspond to both of the identification signal and the floor where the passenger identification means is provided; expected destination floor read means which reads the expected destination floor from the expected destination floor storage means when the passenger identification means issues the identification signal;

an answer light which indicates the thus-read expected destination floor in the car; time-limit means which registers the expected destination floor in a control panel of the elevator as a destination floor of the passenger after having the answer light indicate the expected destination floor for a predetermined period of time; and a car destination button which is provided in the car and registers, as the destination floor of the passenger, a floor newly designated through actuation within the predetermined period of time, in preference to the expected destination floor.

The above object of the present invention is also achieved by an elevator call registration system. The elevator call registration system comprises passenger identification means which is provided in an elevator car and identifies a passenger; expected destination floor storage means which stores, as an expected destination floor of the passenger, a floor which is previously determined so as to corresponding to both of an identification signal issued from the passenger identification means and a floor where the car is located in response to the actuation of the passenger identification means; expected destination floor read means which reads from the expected destination floor storage means the expected destination floor corresponding to both of the identification signal and the floor where the car is located, when the passenger identification means issues the identification signal; an answer light which indicates the thus-read expected destination floor in the car; time-limit means which registers the expected destination floor in a control panel of the elevator as a destination floor of the passenger after having the answer light indicate the expected destination floor for a predetermined period of time; and a car destination button which is provided in the car and registers, as the destination floor of the passenger, a floor newly designated through actuation within the predetermined period of time.

Other objects and further features of the present invention will be apparent from the following detailed description when read in conjunction with the accompanying drawings.

BRIEF DESCRIPTION OF THE DRAWINGS

FIGS. 7A, 7B, 8A and 8B show data structures temporarily set to the expected destination floor storage means shown in FIG. 1;

DESCRIPTION OF THE PREFERRED EMBODIMENTS

In the following, principles and embodiments of the present invention will be described with reference to the accompanying drawings.

First Embodiment

Figure 1:
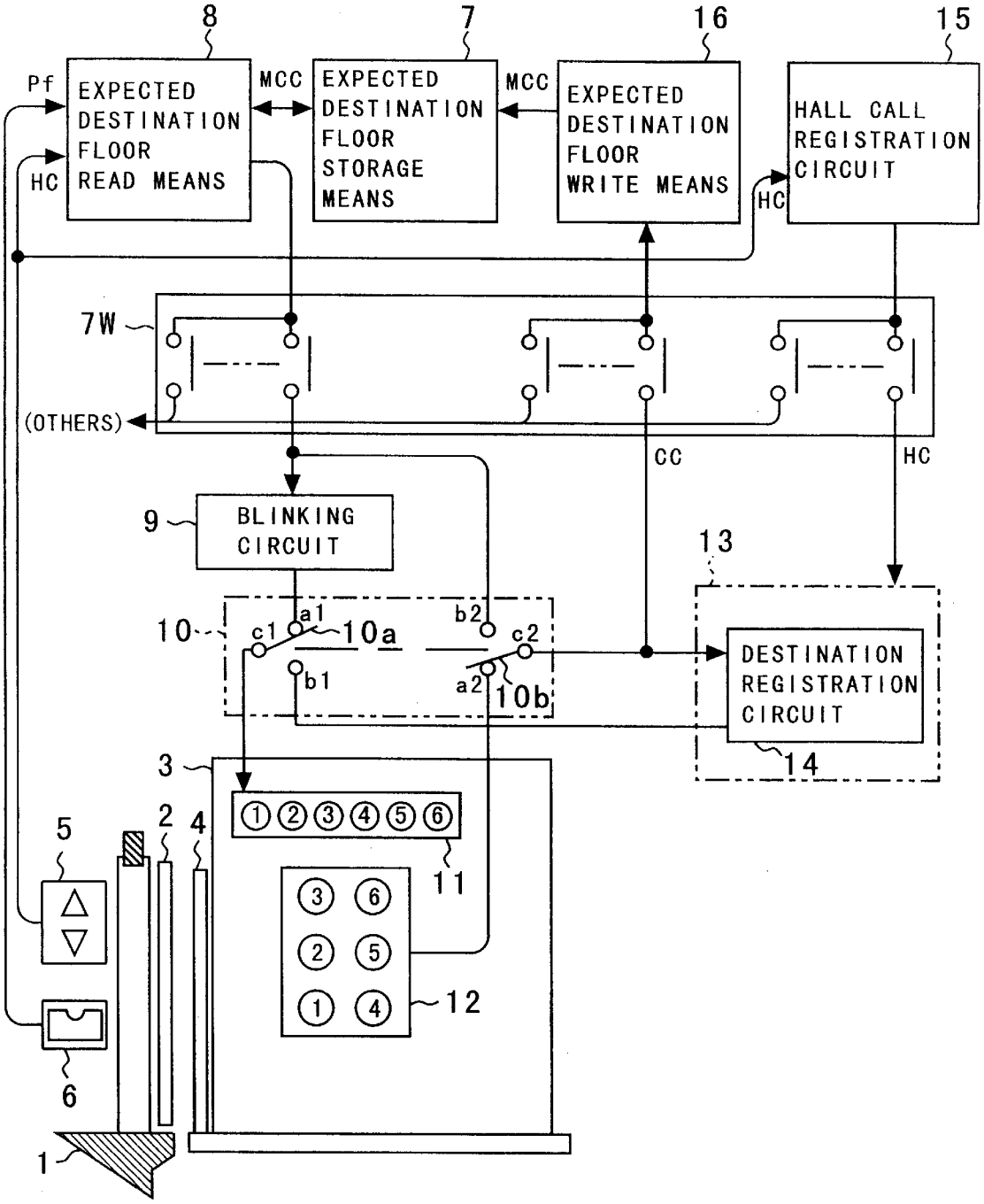
FIG. 1 shows a block diagram of a schematic structure of an elevator call system according to the first embodiment of the present invention.
Figure 2:
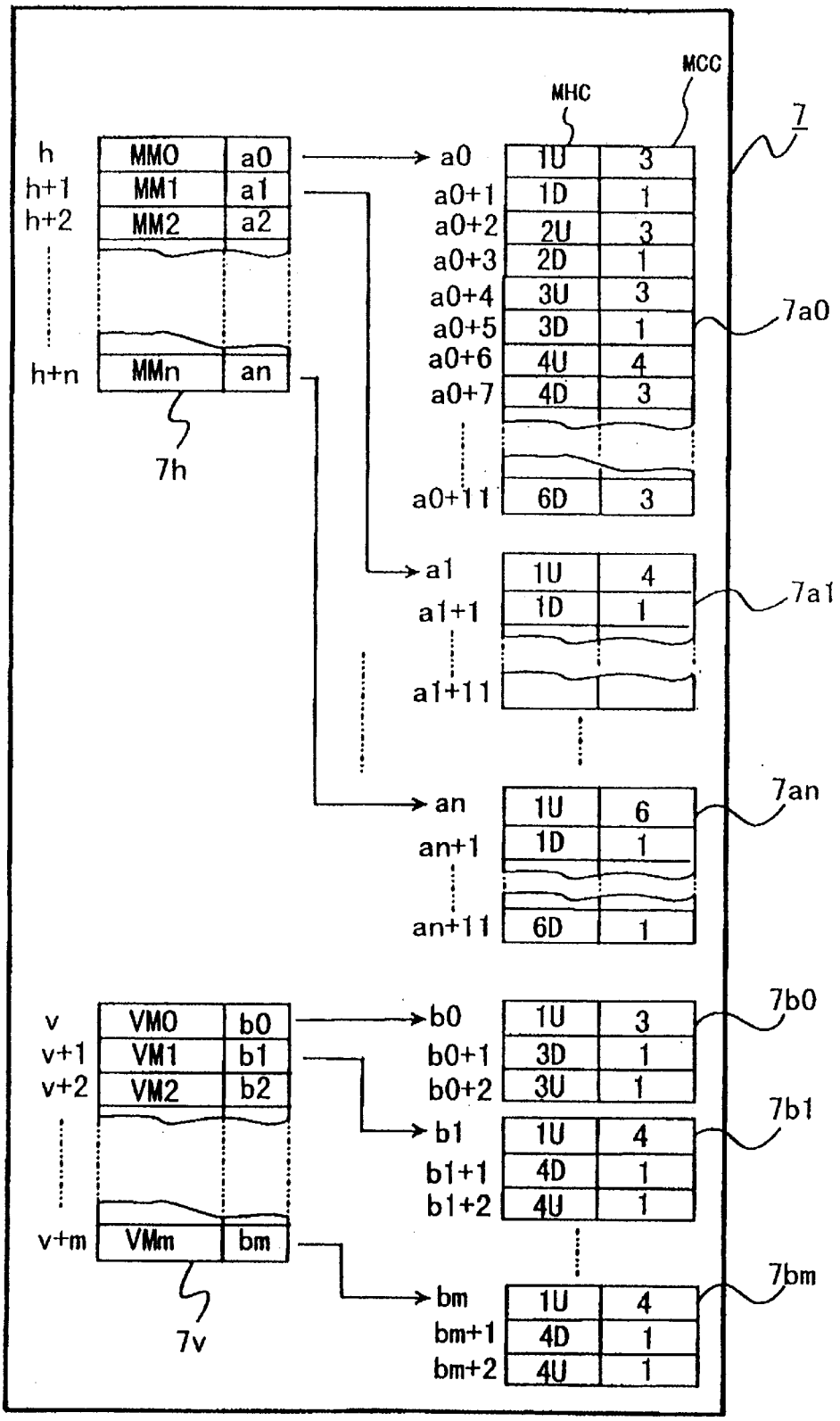
FIG. 2 shows a data structure of an expected destination floor storage means shown in FIG. 1.
Figure 3:
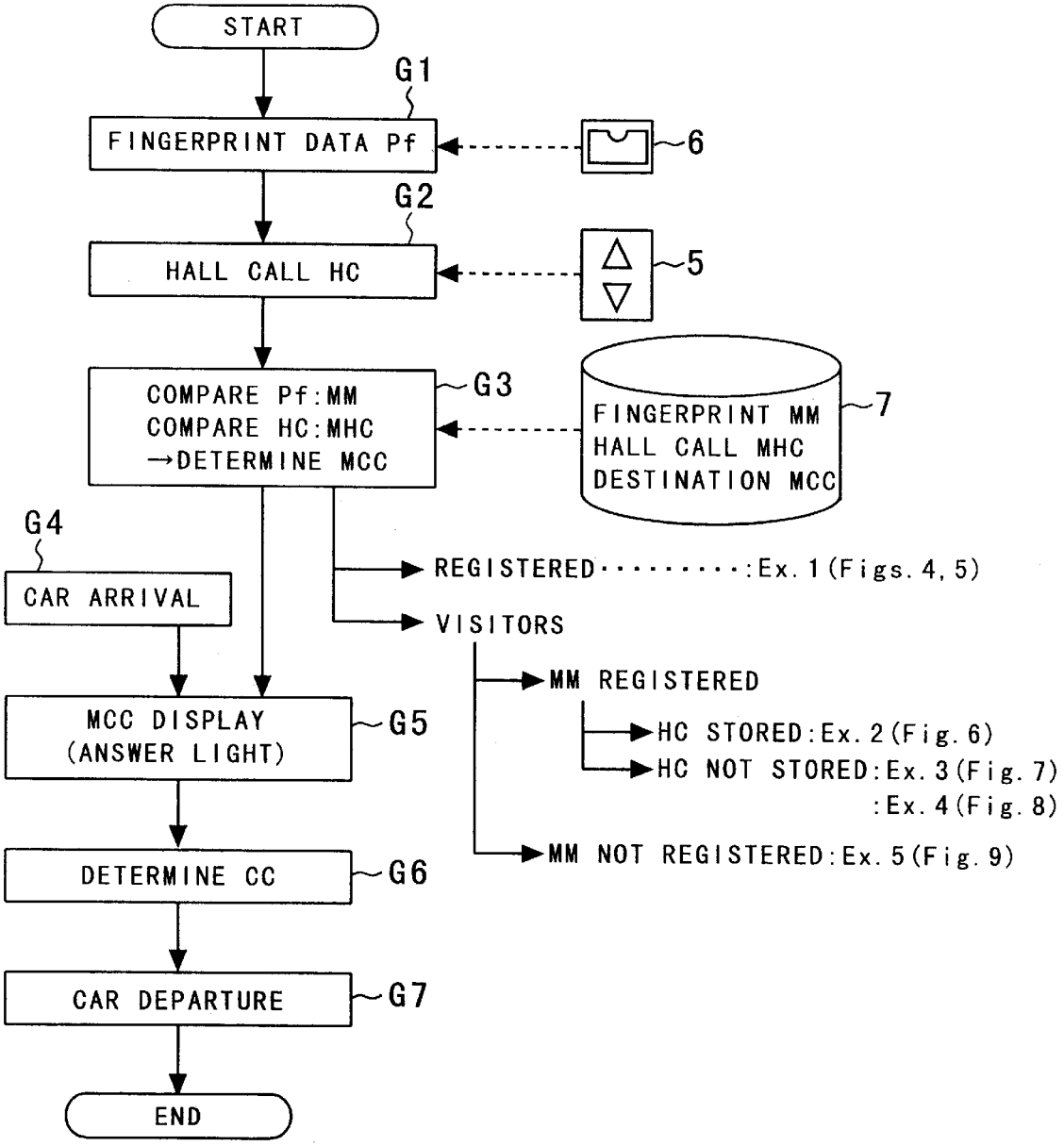
FIG. 3 is a flowchart schematically showing an operation of the elevator call registration system according to the first embodiment.

FIGS. 1 through 6 show an embodiment of the present invention. FIG. 1 is a block diagram showing the overall configuration of an elevator call registration system according to the present invention. In the drawing, reference numeral 1 designates an elevator hall which is provided in a floor of a building and from which a passenger enters an elevator; 2 designates a door of the hall; 3 designates a car; 4 designates a door of the car; and 5 designates a hall button which is provided at the elevator hall 1, generates a hall call (HC) for the purpose of calling the car 3, and comprises an UP button and a DOWN button. Reference numeral 6 designates individual identification means which is provided at the elevator hall 1 and produces an identification signal (Pf) when identifying passengers individually. In the present embodiment, a fingerprint detector is used as the individual identification means 6. Reference numeral 7 designates expected destination floor storage means for storing the passenger's destination and an expected destination floor (MCC). The expected destination floor MCC is determined beforehand based of the combination of the identification signal Pf received from the fingerprint detector 6 and the floor where the fingerprint detector 6 is located. More specifically, the floor—which has the highest probability of being designated by the passenger as a destination at the floor where the fingerprint detector 6 is located—is stored as an expected destination floor MCC. As shown in detail in FIG. 2, according to the first embodiment, a hall call MHC is used as a factor for representing the floor at which the fingerprint detector 6 is provided. Accordingly, there can be respectively set an expected destination floor MCC for a case where the passenger intends to go up from the floor on which the fingerprint detector 6 is provided and an expected destination floor MCC for a case where the passenger intends to go down from the floor (FIG. 2 shows a specific example of the setting). Reference numeral 7W designates an allocation circuit for allocating the hall call HC to one car 3.

Reference numeral 8 designates expected destination floor read means for reading from the expected floor storage means 7 the expected destination floor MCC corresponding to the identification signal Pf issued from the fingerprint detector 6. In practice, the expected destination floor read means is constituted of a microcomputer system. Reference numeral 9 designates a blinking circuit for indicating the thus-read expected destination floor MCC inside the car 3 in a blinking manner only for a given period of time T. Reference numeral 10 designates time limit means for setting the given period of time T and is constituted of two-pole double-throw switches comprising time limit switches 10*a* and 10*b*. The time limit switch 10*a* connects a common terminal c1 to a terminal a1 for only the given period of time T and switches the connection to a terminal b1 after lapse of the given period of time T. The other time limit switch 10*b* connects a common terminal c2 to a terminal a2 for only the given period of time T and switches the connection to a terminal b2 after lapse of the given period of time T. Reference numeral 11 designates an answer light which is provided in the car 3 and indicates the expected destination floor MCC only for the given period of time T. Reference numeral 12 designates a car destination button which is provided in the car 3 and registers the floor newly designated by the passenger by way of operations within the given period of time T as a passenger's destination floor CC in a destination floor registration circuit 14 provided in each control panel 13 of the elevator. The destination floor CC is registered with a priority over the expected destination floor MCC by way of the time limit switch 10*b*. Although the answer light 11 and the car destination button 12 are represented as being different from each other in FIG. 1, an answer light may be provided in each button of the car destination button 12. Reference numeral 15 designates a hall call registration circuit for registering a hall call HC. When the hall call HC is allocated to one car 3 by means of the allocation circuit 7W, the car 3 is drawn to the floor from which the hall call HC was issued. Reference numeral 16 designates expected destination floor write means which writes the destination floor CC input from the car destination button 12 of the allocated car 3 as the expected destination floor MCC into the expected destination floor storage means 7. The expected destination floor MCC can be rewritten through the writing operation.

FIG. 2 shows the details of the expected destination floor storage means 7. More specifically, FIG. 2 shows a six-storied building having the first to sixth floor. Reference numeral 7*a*0 to 7*a*n designate memory devices, each of which corresponds to one passenger. Each memory device stores, for each passenger and for each floor, a hall call MHC and a destination floor MCC—which is expected to be designated with the greatest frequency in response to this MHC. Accordingly, for the entire building the memory devices store such data for n+1 passengers. More specifically, the memory 7a0 is a memory device for one registered passenger. The third floor is stored in an address of a0 as an expected destination floor MCC corresponding to a first-floor UP hall call MHC. The highest probability is employed for the correspondence between the expected destination floor and the call origination floor, in consideration of the traffic line of the registered passenger. Here, the hall call MHC and the expected destination floor MCC are not necessarily stored in one address. Namely, so long as the hall call MHC and the designation floor MCC are related to each other, no problem arises even when they are stored in different addresses. Similarly, the first floor is stored in an address (a0+1) as an expected destination floor MCC corresponding to a first-floor DOWN hall call MHC. Here, the first floor is the lowest floor, and hence the first-floor DOWN hall call MHC should be omitted because it does not exist. However, since there is no harm in setting the expected destination floor MCC to the first floor, the first-floor DOWN hall call MHC is described for the sake of convenience.

In an address of (a0+2), the "third" floor is stored as an expected destination floor MCC corresponding to a second floor UP hall call MHC. Similarly, the "third" floor is stored in an address of "a0+11" as an expected destination floor MCC corresponding to the sixth-floor DOWN hall call MHC. Memory 7a1 is a memory device for another single passenger, and the hall call MHC and the expected destination floor MCC are determined in consideration of the traffic line of the passenger, as in the case of the memory 7a0. In this way, with regard to all the registered passengers, the expected destination floor MCC and the hall call MHC are stored in the memory devices 7a0 to 7an so as to correspond to each other.

Reference numerals 7b0 to 7bm designate memory devices for storing the hall call MHC and the expected destination floor MCC corresponding to the hall call MHC with regard to visitors—who cannot be registered beforehand—in consideration of the traffic line of each visitor. The memory devices have a storage capacity corresponding to (m+1) visitors. The visitors have traffic lines which are comparatively simpler than those of the registered passengers of the building, and they usually do not have inter-floor traffic lines; a desired floor of a visitor is limited to a single floor. Accordingly, it is possible to consider the traffic lines of visitors as ones connecting the first floor and a destination floor.

From the foregoing viewpoint, the third floor is stored in an address of b0 of the memory device 7b0 as a visit path, i.e., an expected destination floor MCC corresponding to a first-floor UP call 1U. The "first" floor is stored in an address of (b0+1) as a return path, i.e., an expected destination floor MCC corresponding to a third-floor DOWN call 3D. The "first" floor is stored in an address of (b0+2) as an expected destination floor MCC corresponding to a third-floor UP call 3U. Although it seems that taking the first floor as an expected destination floor MCC in response to the third-floor UP call 3U is inconsistent, the third-floor UP call 3U is judged to be an operation failure because the traffic lines of the visitors are considered as ones connecting a destination floor and the first floor as mentioned previously. Since there is little inter-floor traffic as mentioned above, the memory devices 7b0 to 7bm for visitor purposes are required to have a small memory capacity. Further, provided that the visitor travels between the lobby and his destination floor, the expected destination floor MCC related to his return path is limited to the lobby, thereby enabling automatic determination of the expected destination floor MCC. If there is need to take into account inter-floor traffic even for a visitor, desired function can be satisfied only by being equal the contents of the memory devices for the visitors to those of the memory devices for registered passengers such as memory device 7a0.

Reference numeral 7c designates a memory device for storing fingerprint data (MM) regarding all the registered passengers. In an address of "h," there are stored fingerprint data MM0 regarding one registered passenger and a leading address of a0 of the memory device 7a0 in which the expected destination MCC of this registered passenger is stored so as to correspond to the fingerprint data MM0. In an address of (h+1), there are stored fingerprint data MM1 regarding another registered passenger and a leading address of a1 of the memory device 7a1 in which the expected destination MCC of the registered passenger is stored so as to correspond to the fingerprint data MM1. Similarly, finger print data MM regarding all the (n+1) registered passengers are stored in addresses from "h" to (h+n).

Reference numeral 7v designates a memory device for storing fingerprint data (VM) regarding visitors. In an address of "v," there are stored fingerprint data VM0 regarding one visitor and a leading address b0 of the memory device 7b0 in which an expected destination floor MCC is stored so as to correspond to the fingerprint data VM0. In an address of (v+1), there are stored fingerprint data VM1 regarding another visitor and a leading address b1 of the memory device 7b1 in which an expected destination floor MCC is stored so as to correspond to the fingerprint data VM1. Similarly, the memory device 7v enables to store a combination of a fingerprint date and a leading address concerning a visitor in each of addresses ranging from "v" to "v+m". Namely, the memory device 7v has a storage capacity for storing fingerprint data VM regarding (m+1) visitors.

The operation of the elevator call registration system will now be described by reference to FIGS. 3 through 9. First, the outline of overall operations of the elevator call registration system will be described by reference to FIG. 3. In step G1, fingerprint data Pf are output from the fingerprint detector 6. In step G2, the hall button 5 sends a hall call HC. In step G3, the fingerprint data Pf and the hall call HC are compared with the fingerprint data MM and the hall call MHC read from the expected destination floor storage means 7, respectively. On the basis of the result of such comparison, the expected destination floor MCC is read from the expected destination means 7. Upon arrival of the car 3 in step G4, for a given period of time the expected destination floor MCC is displayed in step G5 by the answer light 11 provided in the car 3. In step G6, the expected destination floor MCC is taken as a destination floor CC. In step G7, the car 3 departs for the destination floor.

In the following, the processing operations with regard to step G3 will be described being divided in examples 1 through 5.

Figure 4:
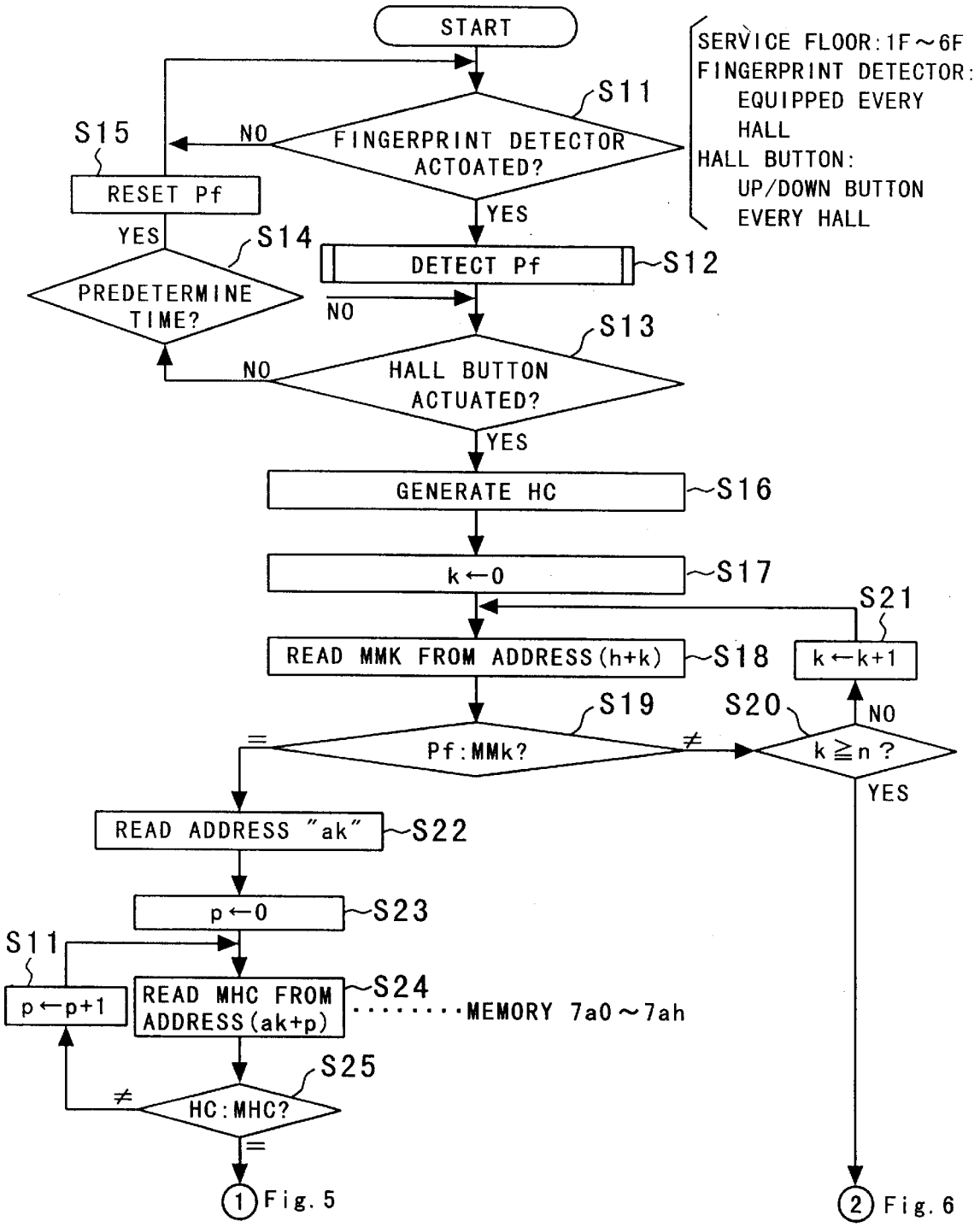
FIGS. 4 and 5 are flowcharts showing processing operations concerning registered passengers.
Figure 5:
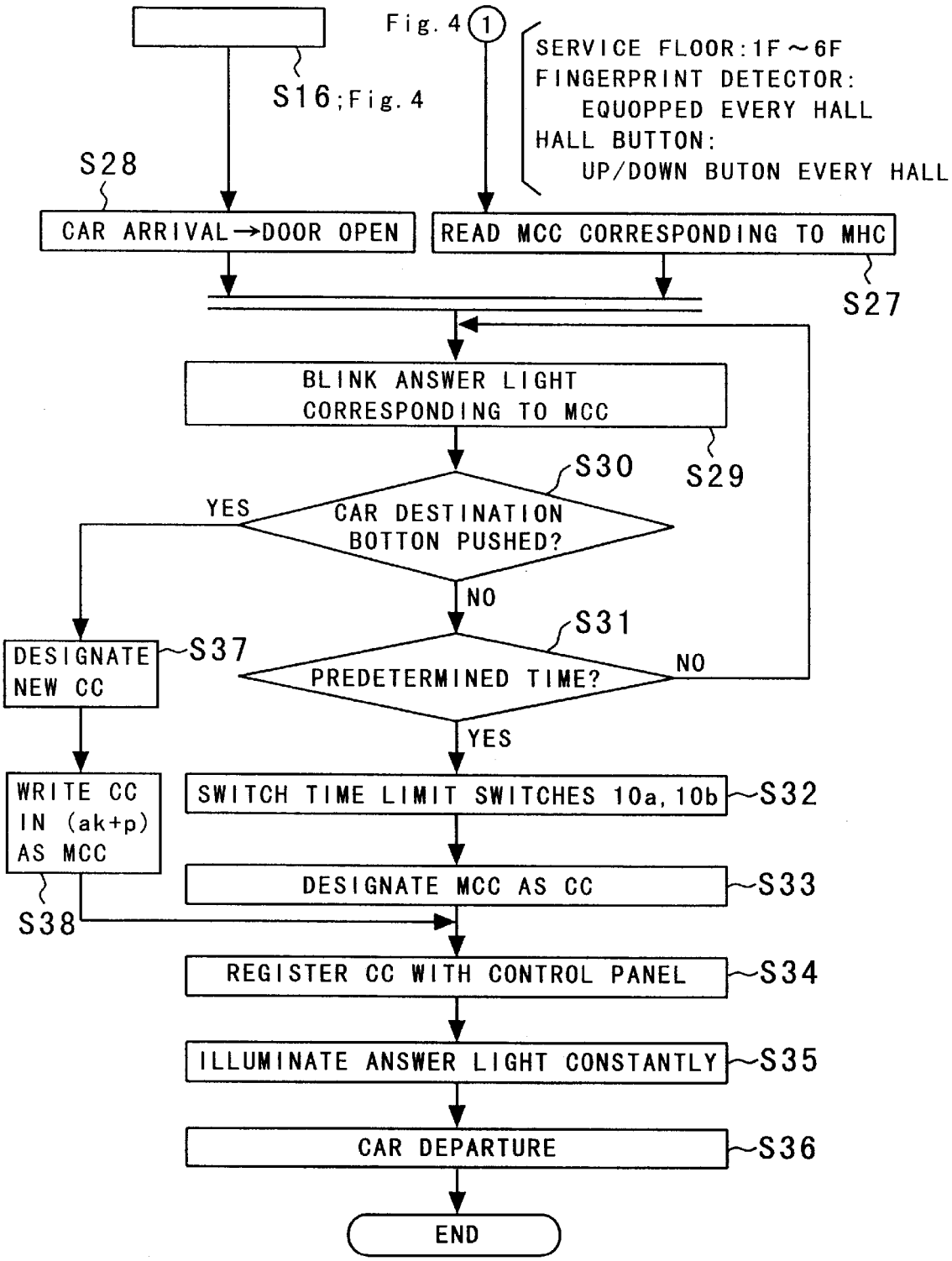

More specifically, example 1 describes a case where passengers are the registered passengers of a building by reference to FIGS. 4 and 5.

Figure 6:
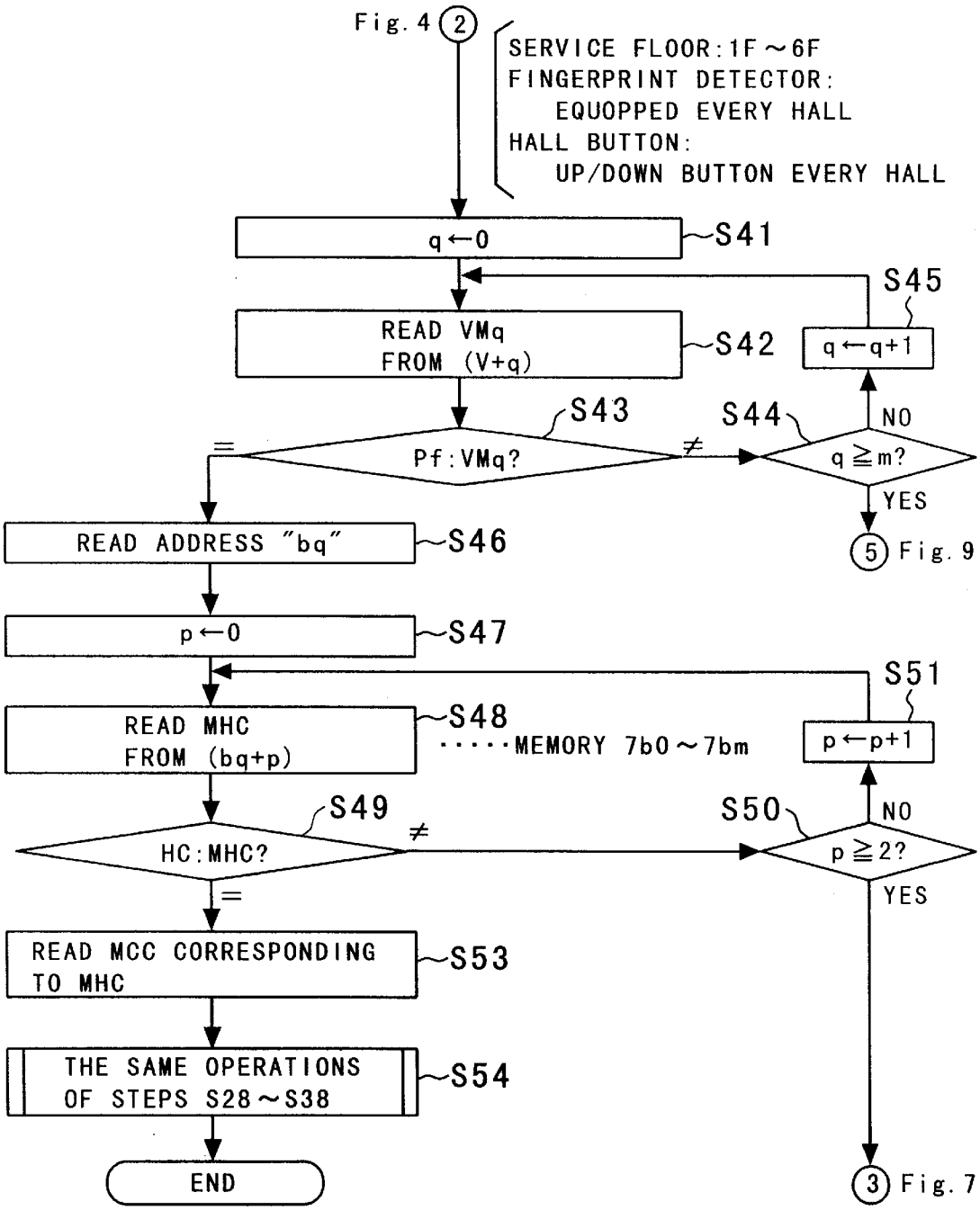
FIGS. 6 through 9 are flowcharts showing processing operations concerning visitors.

Example 2 describes by reference to FIG. 6 a case where the passengers are visitors who have already used the elevator, their fingerprint data MM have been registered, and the data required to determine an expected destination floor MCC have already been stored in the memory 7.

Example 3 describes by reference to FIG. 7*a* case where the passengers are visitors who have already used the elevator, although their fingerprint data MM have been registered but the data required to determine the expected destination floor MCC have not been stored in the memory 7, and there is a first-floor UP hall call HC.

Figure 8:
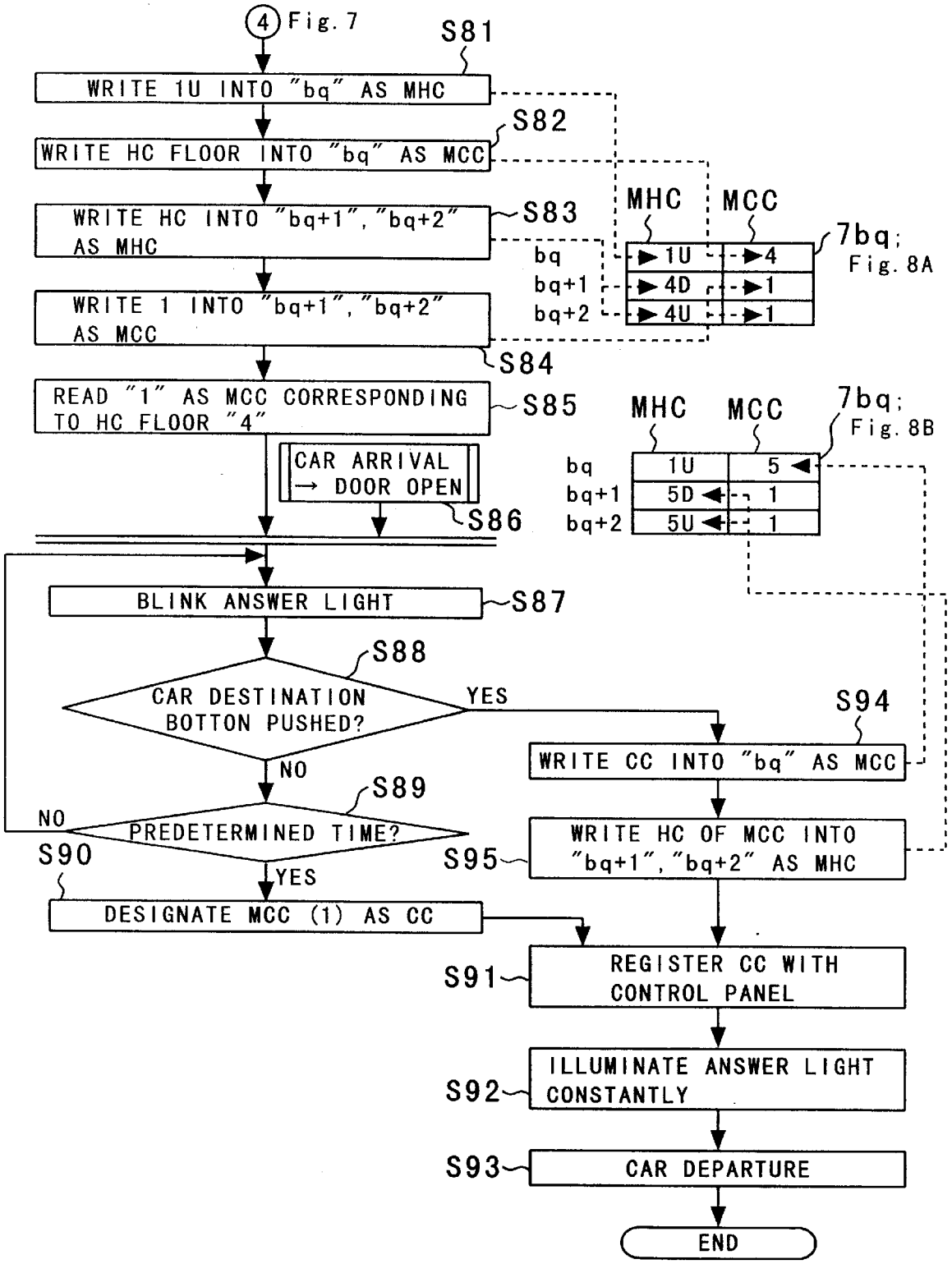

Example 4 describes a case similar to that of example 3, wherein there is a hall call HC other than the first-floor UP hall call On the basis of FIG. 8.

Figure 9:
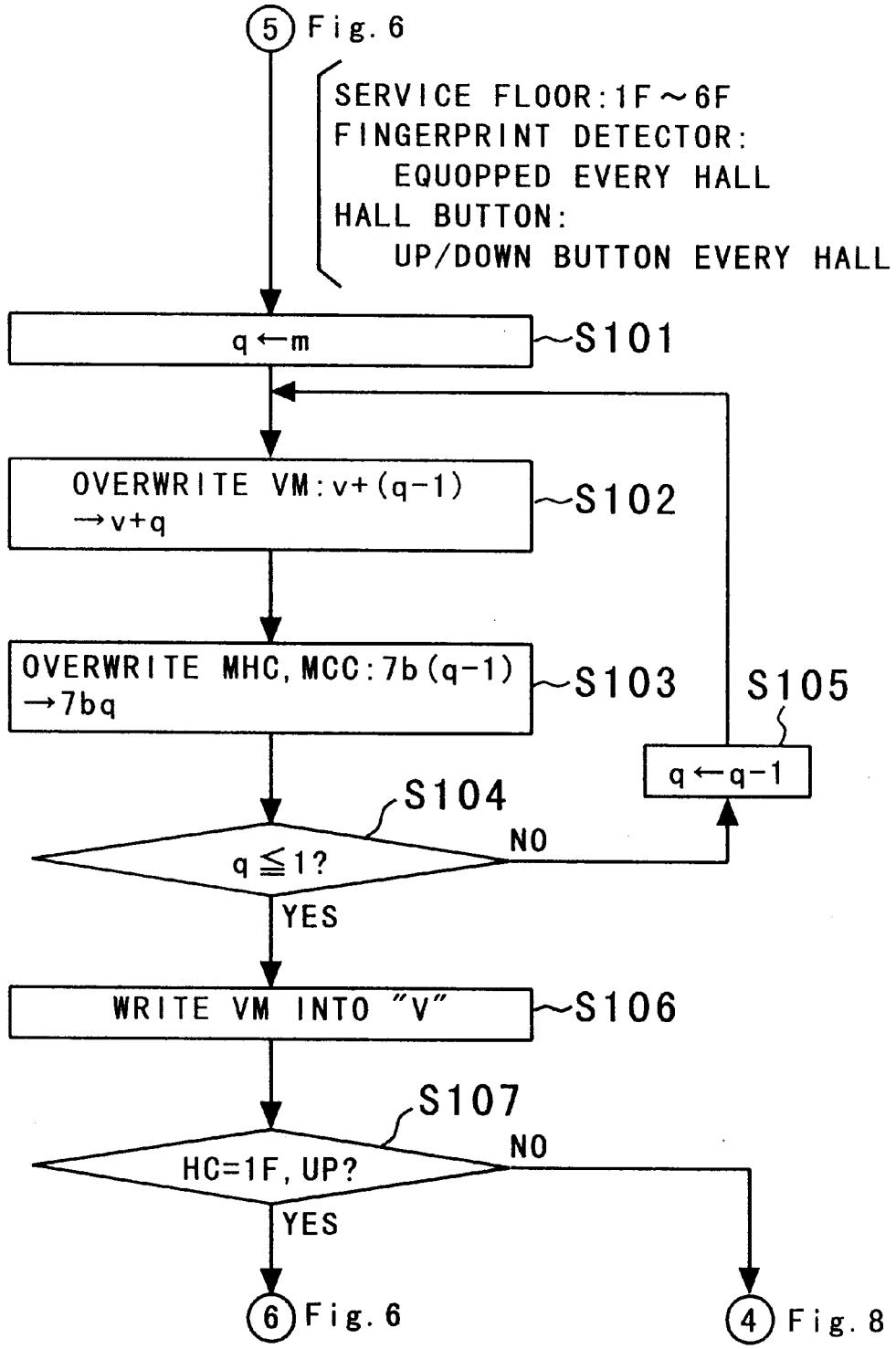

Example 5 describes a case where the fingerprint data MM are not registered, i.e., where a visitor visits the building for the first time On the basis of FIG. 9.

EXAMPLE 1

In step S11 shown in FIG. 4, it is determined whether or not the fingerprint detector 6 is actuated. When the fingerprint detector 6 is actuated, the fingerprint data Pf are detected in step S12, and the thus-detected data are sent to the expected destination floor read means 8. In steps S13 and S14, it is checked whether or not the hall button 5 is actuated within a predetermined period of time. If the hall button 5 is not actuated, the fingerprint data Pf are reset in step S15, and the processing returns to step S11, where the fingerprint detector 6 is brought into a wait mode. When the hall button 5 is actuated, the hall call HC is sent to the expected destination floor reading means 8 in step S16.

In step S17, variable "k" is set to 0 to identify the passenger from the fingerprint data Pf. In step S18, fingerprint data MMk are read from an address of (h+k) of the memory device 7*h*. In step S19, the thus-read fingerprint data are compared with the fingerprint data Pf received from the fingerprint detector 6. As a result, if there is no match between the data sets, the processing returns to step S18 by way of steps S20 and S21. Subsequent fingerprint data MMk are sequentially read, and the thus-read fingerprint data are compared with the fingerprint data Pf in step S19. If there is no match between the fingerprint data Pf received from the fingerprint detector 6 and the fingerprint data MM of the memory device 7*h* through repetition of such comparison up to the final address of (h+n), the passenger isjudged not to correspond to the registered passenger. In this case, processing shown in FIG. 6, which will be described later, will be performed.

In a case where there is a match between the fingerprint data Pf and the fingerprint data MMk of the memory 7*h* in step S19, the passenger is identified as a registered passenger. In this case, the address "ak" stored so as to correspond to the fingerprint data MMk is read in step S22. In step S23, variable "p" is reset to 0. In step S24, the hall call MHC is read from the address ak+p of the memory device 7*a*k in which the hall call MHC and the expected destination floor MCC are stored so as to correspond to each other. In step S25, the thus-read hall call MHC is compared with the hall call HC received from the hall button 5. If there is no match between the hall calls, the variable "p" is incremented in step S26. According to the aforementioned process, the hall call MHC is read out from the reading address ak at first, then sequentially read out from other addresses in every processing cycle. As mentioned previously, in the first embodiment the building is six-storied, and the first-floor DOWN call and the sixth-floor UP call are taken into account. Accordingly, the variable "p" changes from 0 to 11. During the process of the change, the hall call HC inevitably agrees with the hall call MHC.

In a case where there is a match between the hall call HC and the hall call MHC in step S25, the expected destination floor MCC corresponding to the hall call MHC is read from the memory 7*a*k in step S27 shown in FIG. 5. In step S28, the doors 2 and 4 open after the car 3 allocated to the hall call HC arrives at the floor. In step S29, the answer light 11 of the floor corresponding to the expected destination floor MCC is caused to blink only for the predetermined period of time T, by way of the allocation circuit 7W, the blinking circuit 9, and the terminals a1 and c1 of the time limit switch 10*a*. Further, during the predetermined period of time T, the terminals a2 and c2 of the time switch 10*b* are connected together. Accordingly, the destination floor CC can also be directly registered in the destination floor registration circuit 14 of the elevator control panel 13 by pushing the car destination button 12. In steps S30 and S31, it is determined whether or not the car destination button 12 is actuated within the predetermined period of time T.

After elapse of the predetermined period of time T, the processing proceeds to step S32. In step S32, the time limit switches 10*a* and 10*b* are switched so that the terminals b1 and c1 and the terminals b2 and c2 are connected together, respectively. As a result of such switching operations, it becomes impossible for the passenger to register the destination floor CC by way of the car destination button 12 and the expected destination floor read means 8 is brought into connection with the destination floor registration circuit 14 of the control panel 13. As a result, the expected destination floor MCC is input as the destination floor CC into the control panel 13 in steps S33 and S34. Further, since the answer light 11 is connected to the destination floor registration circuit 14 in a manner similar to that mentioned above, the destination floor CC is illuminated without blinking in step S35. In step S36, the car 3 departs for the destination floor CC.

When the car destination button 12 is actuated within the predetermined period of time T in step S30, a new destination floor CC is designated through the actuation of the button and is input to the control panel 13 in step S37. In step S38, the destination floor CC is newly written into the address (ak+p) as an expected destination floor MCC by means of the expected destination floor write means 16, in place of the expected destination floor MCC that has been previously stored in the address. In step S34, the destination floor CC designated by the car destination button 12 is input to the control panel 13. In step S35, the answer light 11 is illuminated without blinking. Finally, in step S36, the car 3 departs for the destination floor CC.

EXAMPLE 2

Hereinafter, an explanation will now be given by reference to FIGS. 6 through 9 of a case where the passenger is judged not to correspond to a registered passenger, i.e., judged to be a visitor in step S20 shown in FIG. 4.

Provided that a visitor is not allowed to use an elevator, the processing can be immediately terminated when the passenger is judged to be a visitor in step S20. In an apartment house where crime prevention is particularly essential, there is great demand for preventing a visitor from using the elevator. However, under normal circumstances, even visitors are considered to frequently visit the apartment house. Accordingly, it is also conceivable that visitors are handled as are the registered passengers through use of the memory 7*v* for visitor purposes as shown in FIG. 2. To handle a visitor as a registered passenger, a check should be made at first as to whether or not the visitor is registered in the memory device 7*v*.

In step S41 shown in FIG. 6, variable "q" is reset to 0 in order to identify a passenger by means of the fingerprint data Pf. In step S42, fingerprint data VMq at an address of (h+q) are read from the memory device 7*v*. In step S43, the thus-read fingerprint data VMq are compared with the fingerprint data Pf received from the fingerprint detector 6. If there is no agreement between these data sets, the processing returns to step S42 by way of steps S44 and S45. The subsequent fingerprint data VMq are sequentially read, and the thus-read fingerprint data VMq are compared with the fingerprint data Pf in step S43. If there is no agreement between the fingerprint data Pf received from the fingerprint detector 6 and the fingerprint data VM of the memory device 7*v* even after repetition of such comparison up to the final address of (v+m), the passenger is judged not to correspond to a registered passenger, and the judgment result is stored in the memory 7*v*. An example of such processing will be described later by reference to FIG. 9.

If there is agreement between the fingerprint data Pf and the fingerprint data VMq of the memory device 7*v* in step S43, the passenger is judged to be a pre-registered visitor. In this case, the address of "bq" registered so as to correspond to the fingerprint data VMq is read in step S46. In step S47, variable "p" is reset to 0. In step S48, the hall call MHC is read sequentially from the leading address "bq" of the memory 7*b*q in which the hall call MHC and the expected destination floor MCC are stored so as to correspond to each other. In step S49, the thus-read hall call MHC is compared with the hall call HC received from the hall button 5. If there is no agreement between the data sets, a check is made in step S50 as to whether or not such comparison has been performed up to the final address of the memory 7*b*q. If the comparison has not yet been completed up to the final address, the variable "p" is incremented in step S51, and the comparison is performed up to the final address.

In example 2, the visitor is assumed to enter at the first floor of the building, go to a destination floor by means of the elevator, and return to the first floor from the destination floor. Accordingly, as shown in FIG. 2, the memory devices 7*b*0 and 7*b*1 to 7*b*m are configured so that in a case where the hall call MHC is generated at the first floor, the destination floor CC that was visited by the visitor last time he visited the building is set as the corresponding expected destination floor MCC and that in a case where the hall call MHC is generated at other floor than the first floor, the first floor is automatically set as the corresponding expected destination floor MCC.

If there is agreement between the hall call HC and the hall call MHC in step S49, the expected destination floor MCC corresponding to the hall call MHC is read from the memory device 7*b*q instep S53. In step 54, a series of operations corresponding to steps S28 through S38 shown in FIG. 5 are performed. Consequently, the return path of the visitor is automatically set to the first floor. However, if the visitor intends to drops in at another floor rather than going directly down to the first floor, the visitor can go to a desired floor so long as he actuates the car destination button 12 within the predetermined period of time T so that the operations of steps S30, S37, S38, and S34 shown in FIG. 5 are sequentially performed. Such an operation is similar to that required to register a hall call in an existing elevator, so that the passenger is considered not to have a sense of incongruity. An operation in a case where the passenger goes down to the first floor by means of the elevator from the floor where he dropped in will be described later in a description of example 4.

EXAMPLE 3

Figure 7:
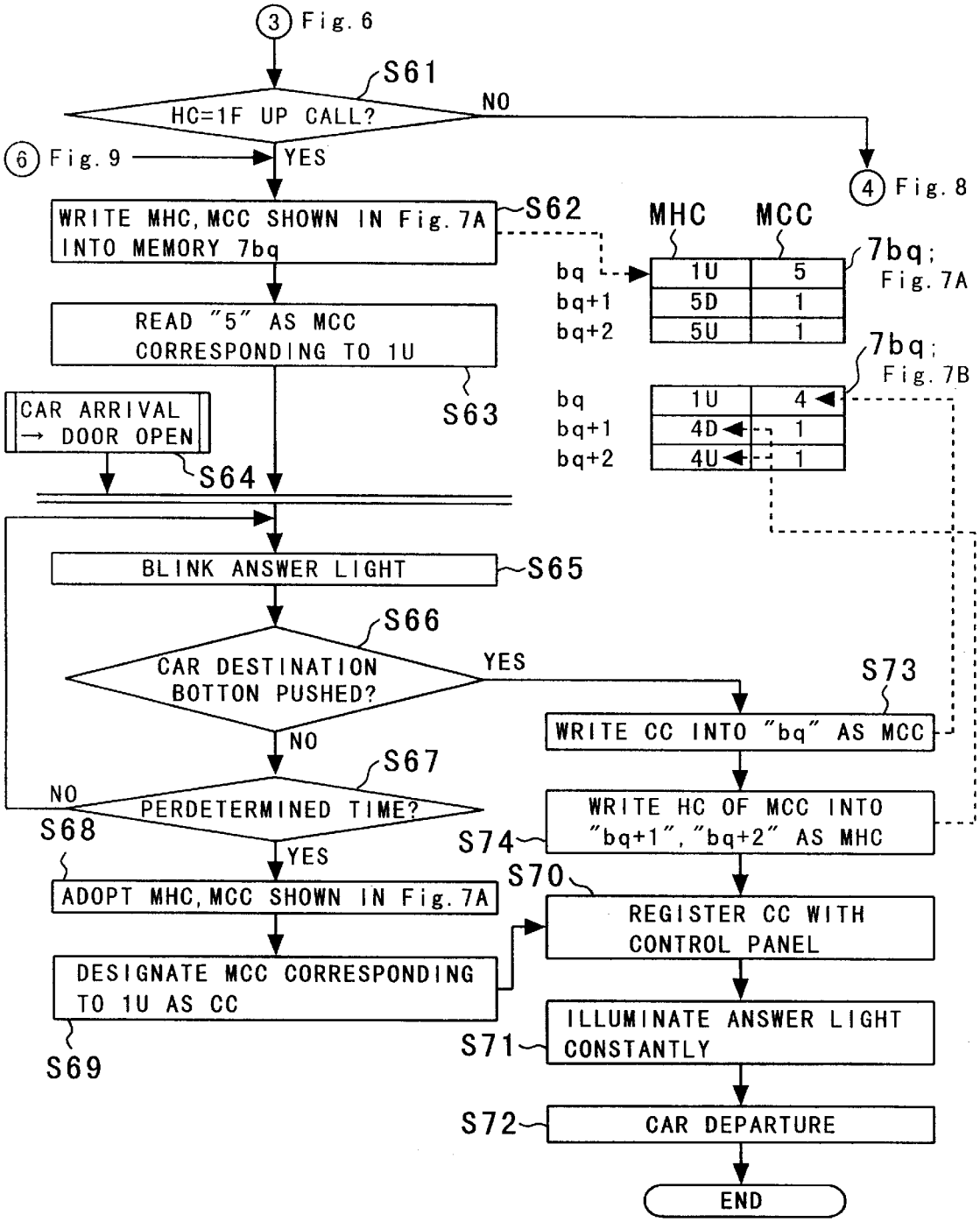

In a case where the hall call HC received from the hall button 5 is not stored in the memory 7*b*q, Y is selected in step S50, and the processing shown in FIG. 7 is performed. More specifically, in contrast to the registered passenger, the visitor is considered to travel between the lobby and his destination floor and not to travel among floors. Accordingly, the hall call MHC does not have a sufficient capacity for storing hall calls HC regarding all the floors. For this reason, although the fingerprint data VMq of the visitor are recorded in the memory 7*v*, there may be a case where the hall call MHC corresponding to the hall call HC received from the hall button 5 byway of visitor's actuation is not recorded in any of addresses bq to (bq+2) of the memory device 7*b*q corresponding to the fingerprint data VMq.

FIGS. 7 and 8 show examples of processing required to determine, in the foregoing case, the hall call MHC and the expected destination floor MCC of the memory 7*b*q based on the hall call HC and the destination floor CC received from the car destination button 12.

In a case where Y is selected in step S50 shown in FIG. 6, namely, where the expected destination floor MCC is not found in the memory 7*b*q, in place of the processing shown in FIGS. 7 and 8, the car destination button 12 may be made effective only for the predetermined period of time T from when it is found that the MCC is not stored in the memory 7*b*q. In this case, the destination floor CC designated by the car destination button 12 during the period of time T may be registered in the destination floor registration circuit 14.

Example 3 shows the processing performed when the hall call HC is found to be a first-floor UP call as a result of the examination performed in step S61 shown in FIG. 7. The processing related to the hall call other than the first-floor UP call is shown in FIG. 8 as example 4.

In step S62, the hall call MHC and the expected destination floor MCC of the memory device 7*b*q are temporarily set as shown in FIG. 7A. Since the visitor are assumed to travel back and forth, the hall call of the destination floor CC on the visit path is stored as the hall calls MHC stored in the addresses (bq+1), (bq+2). In step S63, five is read as the expected destination floor MCC corresponding to the first-floor hall call 1U. In step S64, the doors 2 and 4 open after the car 3 arrives at the first floor in response to the hall call HC. Subsequently, in step S65, the answer light 11 corresponding to the expected destination floor MCC "5" is caused to blink by means of the blinking circuit 9 and the time limit switch 10*a*. The answer light 11 corresponding to the expected destination floor MCC "5" is caused to blink only for the predetermined period of time T by way of steps S66, S67, and S65. In a case where the passenger decides that there is no need to change the destination floor when viewing the blinking answer light, the temporary setting shown in FIG. 7A is adopted as is for the memory 7*b*q after elapse of the predetermined period of time T (step S68). In step S69, the expected destination floor MCC corresponding to the hall call 1U is taken as the destination floor CC. In step S70, the destination floor CC is registered in the elevator control panel 13. The answer light 11 is illuminated without blinking in step S71, and the car 3 departs for the destination floor CC in step S72.

When the car destination button 12 is actuated within the predetermined period of time T, the processing proceeds to step S73 from step S66, and the destination floor CC designated by the car destination button 12 is written into the address bq as the expected destination floor MCC. Further, in step S74, the hall call HC of the expected destination floor MCC is written as the hall calls MHC of the addresses (bq+1), (bq+2). More specifically, in steps S73 and S74, the temporarily-set memory 7*b*q is rewritten from the contents shown in FIG. 7A to those shown in FIG. 7B. In step S70, the destination floor CC designated by the car destination button 12 is registered in the control panel 13, and the car 3 departs for the destination floor CC, i.e., the first floor, in the manner mentioned previously. The next time the visitor visits the building, the floor he went to this time is automatically registered in the control panel 13 as the destination floor CC.

EXAMPLE 4

FIG. 8 illustrates a case where, although the fingerprint data of the visitor are recorded in the memory 7*v*, the hall call MHC corresponding to the hall call HC received from the hall button 5 is not recorded in the memory 7*b*q, and the hall call HC received from the hall button 5 is other than the first floor. For example, there is conceivable a case where the visitor goes up via stairs and goes down by the elevator.

Steps S81 through S84 are processing operations for the purpose of writing the contents shown in FIG. 8A into the memory 7*b*q. More specifically, when the visitor is producing a hall call HC at the floor other than the lobby, there can be made an assumption that the first-floor UP call 1U may originally serves as the starting point and the floor—at which the hall call HC is currently produced—may serve as the destination floor CC from now on. In steps S81 through S84, the visitor is automatically registered as traveling between the first floor and the destination floor on the basis of the assumption.

More specifically, in step S81, the first-floor UP call 1U is written in the address bq of the memory 7*b*q as the hall call MHC. In step S82, the floor at which the hall call HC is produced is written as the expected destination floor MCC of the address bq. In step S83, the hall call HC is written as the hall call MHC of the addresses (bq+1), (bq+2). Further, in step S84, the first floor is written as the expected destination floor MCC of the addresses (bq+1), (bq+2). In step S85, "one" is read from the memory 7*b*q as the expected destination floor MCC corresponding to the floor "4" at which the hall call is produced. In step S86, the doors 2, 4 open after the allocated car 3 arrives at the floor "4" at which the hall call HC is produced. Subsequently, in step S87, the answer light 11 corresponding to the expected destination floor MCC is caused to blink by means of the blinking circuit 9 and the time limit switch 10*a*. In a case where the passenger decides that there is no need to change the destination floor when viewing the blinking answer light, the temporary setting shown in FIG. 8A is adopted as is for the memory 7*b*q after elapse of the predetermined period of time T (steps S88 and S89). In step S90, the expected destination floor MCC, i.e., "one" is taken as the destination floor CC. In step S91, the destination floor CC is registered in the control panel 13. Simultaneously, the answer light 11 is illuminated without blinking in step S92, and the car 3 departs for the destination floor CC in step S93.

When the car destination button 12 is actuated within the predetermined period of time T, the processing proceeds to step S94 from step S88, and the destination floor CC designated by the car destination button 12 is written into the address bq as the expected destination floor MCC. Further, in step S95, the hall call HC of the expected destination floor MCC designated by the car destination button 12 is written as the hall calls MHC of the addresses (bq+1), (bq+2). More specifically, insteps S94 and S95, the temporarily-set memory 7*b*q is rewritten from the contents shown in FIG. 8A to those shown in FIG. 8B. In step S91, the destination floor CC designated by the car destination button 12 is registered in the control panel 13. After that, the car 3 departs for the destination floor CC, i.e., the first floor, in the manner as mentioned previously. The visitor will be registered according to the contents of the memory 7*b*q shown in FIG. 8B when visiting the building next time.

EXAMPLE 5

FIG. 9 shows the processing performed when a visitor cannot be identified, because his fingerprint data VM are not yet recorded in the memory 7*v*.

Fingerprint data VM regarding a new visitor are recorded in the leading address of the memory 7*v*, namely, an address of "v" shown in FIG. 2. For this reason, the existing fingerprint data VM are shifted in order by one address. As a result of shifting of the data, the fingerprint data VM1 at address (v+1) is rewritten to the same data as the fingerprint data VM0 which was recorded in address "v". Further, the fingerprint data VMm at the final address (v+m) is rewritten to the same data as the fingerprint data VM(m−1) which was recorded in address (v+m−1), thereby eliminating the fingerprint data VMm which was recorded in address (v+m).

In response to the shift of the fingerprint data VM, the contents of the memories 7*b*0 to 7*b*m must also be shifted. As a result of the shift, the hall call MHC and the expected destination floor MCC recorded in the memory 7*b*0 are overwritten on the memory 7*b*1. Further, the hall call MHC and the expected destination floor MCC recorded in the memory 7*b*(m−1) are overwritten on the final memory 7*b*m, thereby eliminating the contents already recorded in the memory 7*b*m.

Steps S101 through S106 shown in FIG. 6 relate to the shift operations mentioned above. In order to prevent elimination of data, the fingerprint data must be shifted in descending order from the final address. In step S101, the variable "q" is set to "m." In step S102, the fingerprint data recorded in address {v+(q−1)} are overwritten on address (v+q). In step S103, the corresponding data, i.e., the hall call MHC and the expected destination floor MCC recorded in the memory 7*b*(q−1), are overwritten on the memory 7*b*q. In step S104, it is determined whether or not the fingerprint data are shifted to the leading address "v" or the leading memory 7*b*0. After the fingerprint data have been shifted to the leading address through sequential shifting of the data, the processing proceeds to step S106. In step S106, the fingerprint of a new visitor is written into the leading address "v," thus rendering the new visitor an identifiable person.

During the subsequent processing, it is determined in step S107 whether or not the hall call HC produced by the visitor actuating the hall button 5 is the first-floor UP call. If the hall call is the first-floor UP call, as indicated by a connector 6, the processing starting from step S62 shown in FIG. 7 is executed. In this case, memory 7*b*0 serves as the memory 7*b*q. In contrast, if the hall call is other than the first-floor UP call, as indicated by a connector 4, the processing starting from step S81 shown in FIG. 8 is executed. Similarly, the memory 7*b*0 is also used as the memory 7*b*q in this case.

According to the first embodiment, with regard to the registered passenger, one expected destination floor MCC is set for each of the UP and DOWN hall buttons 5. Accordingly, it is assumed that the destination floor CC will match the passenger's desired floor with high probability.

Moreover, according to the present invention, it is also possible to register visitors automatically.

Further, since fingerprints of the passengers are automatically recorded as well as their destination floors are, crimes are efficiently prevented. Particularly, the present invention is greatly significant in preventing a visitor from committing a crime.

Although in the first embodiment the fingerprint detector 6 is used as personal identification means, an identification card reader may alternatively be used.

Although in the first embodiment the fingerprint detector 6 and the hall button 5 are provided independently, the fingerprint detector itself may be used as UP and DOWN hall buttons. In this case, hall call and detection of a fingerprint can be performed in a single operation.

In a case where a new visitor whose fingerprint is not yet recorded is recorded in the expected destination floor storage means 7, the fingerprint is written into the leading address of the memory in the foregoing embodiment. However, the fingerprint may also be written into the final address of the memory. More specifically, a new fingerprint may be always written into a predetermined address, and the existing fingerprint data may be shifted following a given sequence from the predetermined address. As a result, the visitor who visited the building only once is naturally deleted, and only those visitors who frequently visit the building are recorded, thus enabling effective use of memory.

Second Embodiment

Figure 10:
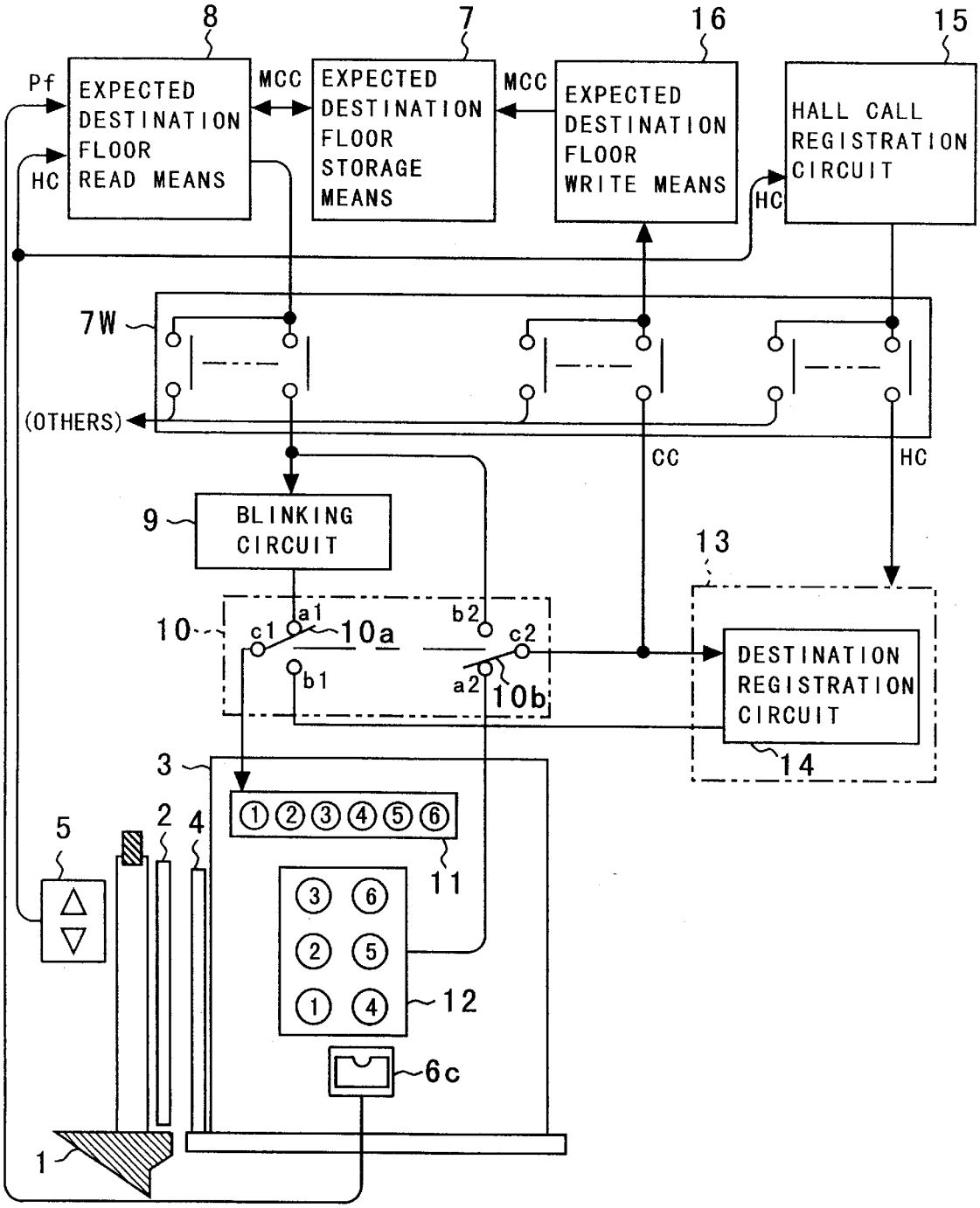
FIG. 10 shows a block diagram of a schematic structure of an elevator call system according to the second embodiment of the present invention.

FIG. 10 shows an elevator call registration system in which only the hall button 5 is provided at each elevator hall 1 and a fingerprint detector 6*c* is provided in the car 3. In this embodiment, the car 3 is called by means of the hall button 5 at first. An identification signal Pfc is sent to the expected destination floor read means 8 from the fingerprint detector 6*c* after passengers enter the car 3. The passenger can be identified by the identification signal Pfc, and the expected destination floor MCC can be read from the expected destination floor storage means 7 on the basis of the result of such identification and the hall call HC. Since the present embodiment is identical in other respects to the first embodiment, repetition of its explanation is omitted here.

According to the second embodiment, only one fingerprint detector is required to be placed in the car 3, thus rendering the elevator call registration system less expensive than the system according to the first embodiment in which the fingerprint detector is provided on each floor.

The expected destination floor MCC is determined in connection with the floor from which the passenger departs. Accordingly, the floor from which the passenger produced the fingerprint signal Pfc must be detected in order to read the expected destination floor MCC. In contrast, in a case where the fingerprint detector 6 is provided in the car 3, the relationship between the identification signal Pfc and the floor is not determined. For this reason, in order to determine the relationship between the identification signal Pfc and the floor, it is necessary to read the floor where the car 3 is located from the control panel 13 of the elevator and to determine the relationship between the hall call HC of the thus-read floor and the identification signal Pfc. Specifically, since the passenger must enter the car 3, the timing at which the fingerprint detector 6*c* is actuated may be limited to the period of time during which the car door is open or to the time period from when the door starts opening to the time the car 3 starts ascending or descending. A device for detecting the floor where the car 3 is located is already known and commonly used, and hence its explanation is omitted here.

Third Embodiment

Figure 11:
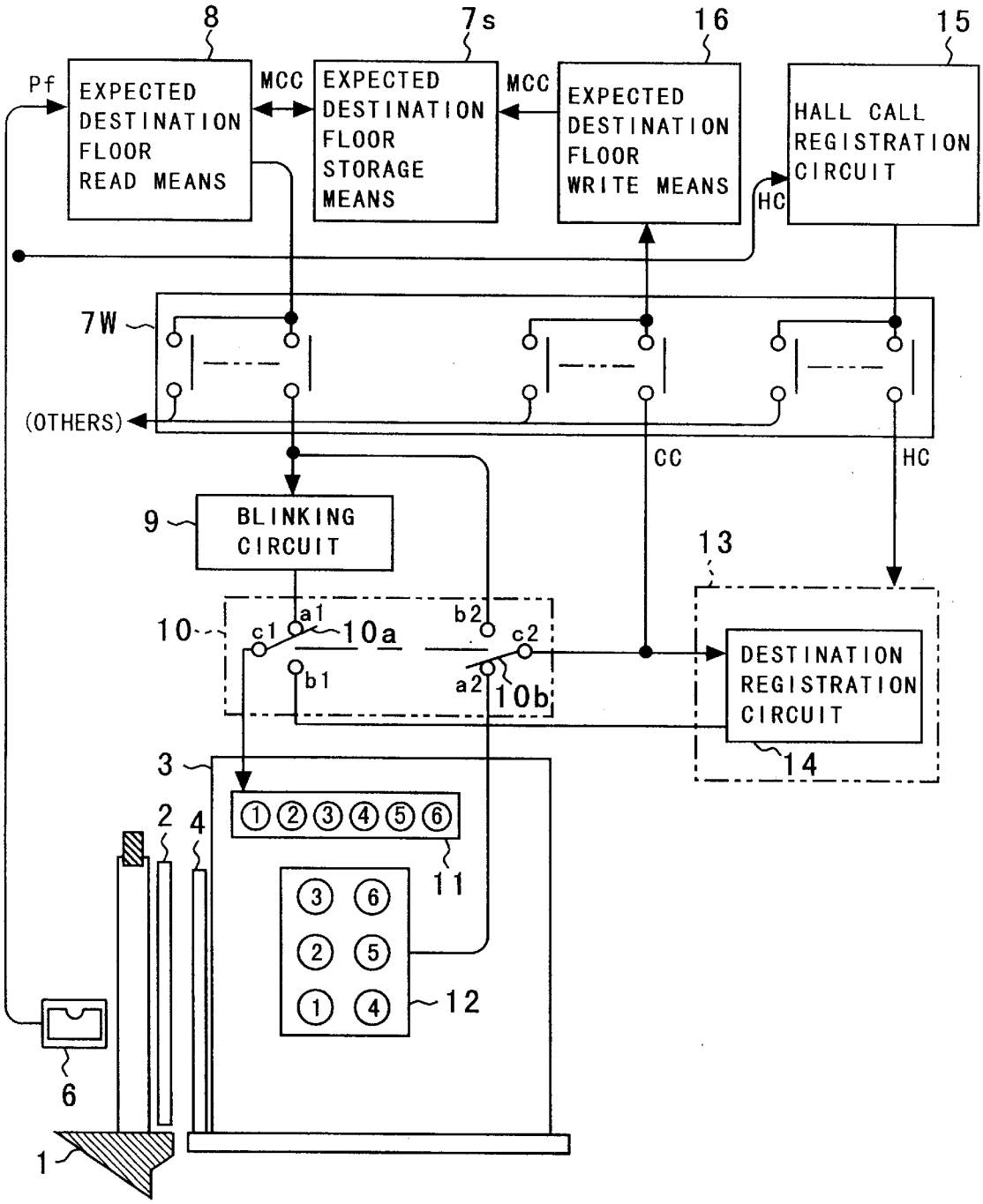
FIG. 11 shows a block diagram of a schematic structure of an elevator call system according to the third embodiment of the present invention.
Figure 12:
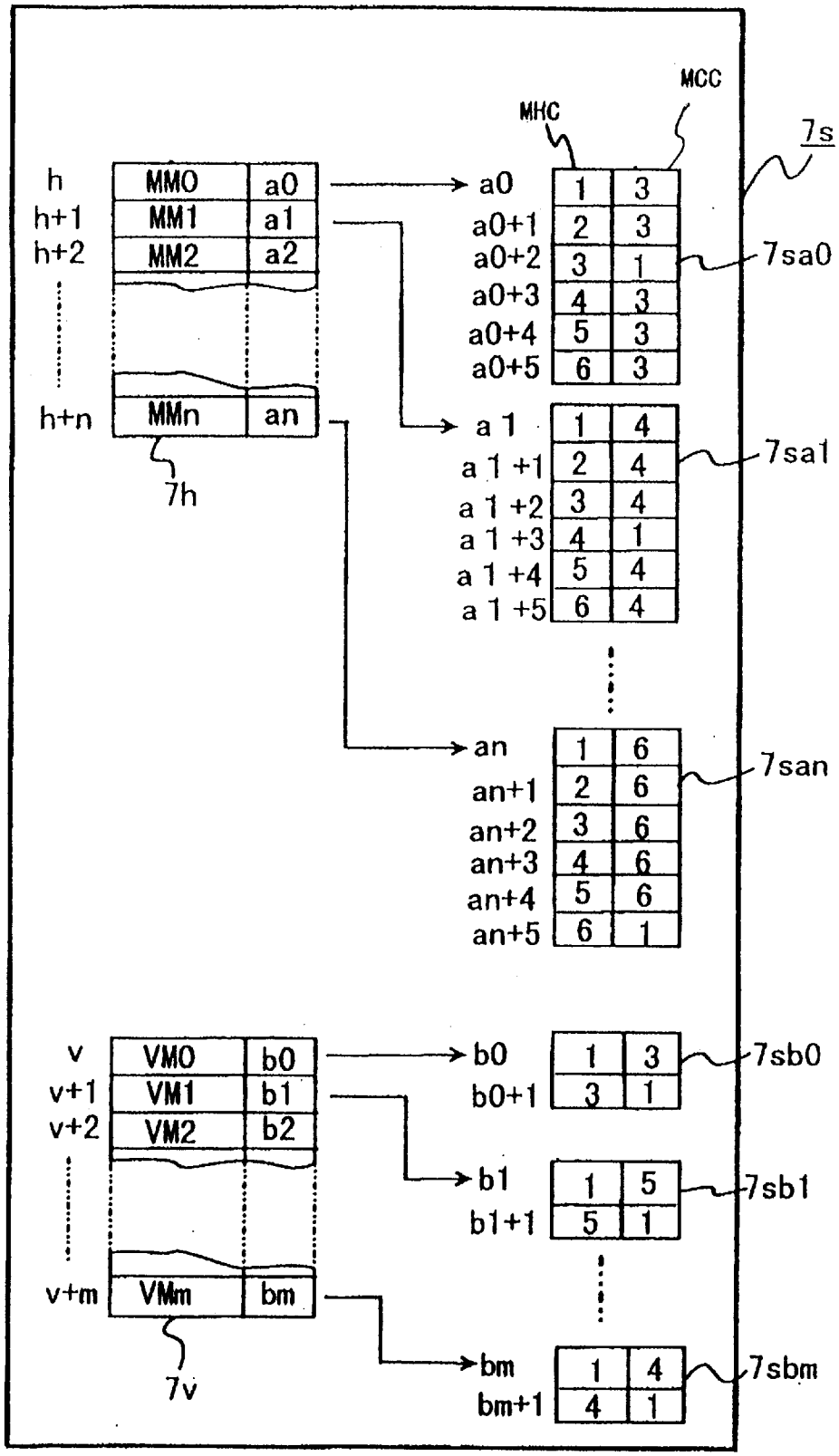
FIG. 12 shows a data structure of an expected destination floor storage means shown in FIG. 11.

FIG. 11 shows an elevator call registration system in which the hall button 5 is eliminated and one fingerprint detector 6 is provided in each hall 1. In the third embodiment, the fingerprint detector 6 is actuated at first. When the fingerprint detector 6 is actuated the passenger is identified based on the identification signal Pf issued as a result of the actuation and the car 3 starts moving toward the floor where the identification signal Pf is issued. Since only one fingerprint detector 6 is provided in the hall, the intended direction of the passenger cannot be read from the identification signal Pf. For this reason, as shown in FIG. 12, the contents of the expected destination floor storage means 7s according to the third embodiment comprise one hall call MHC and one corresponding expected destination floor MCC for each floor.

Even in the third embodiment, the expected destination floor MCC recorded in the expected destination floor storage means 7*s* can be read based on the identification signal Pf and the hall call MHC corresponding to the signal Pf. If the expected destination floor MCC is different from the passenger's intended floor, the destination can be corrected by actuation of the car destination button 12 within a predetermined period of time T. Further, even the visitor whose fingerprint has not yet been registered can be subjected to hall call registration. Specific details of the registration are the same as those described in the first embodiment, and repetition of their explanations is omitted here.

Fourth Embodiment

The traffic line of a person within a building differs from a time period to another. For example, the person takes characteristic traffic lines for a time period during which he goes to the office, for lunch time, for a time period during which he leaves the office, and for working hours, respectively.

Figure 13:
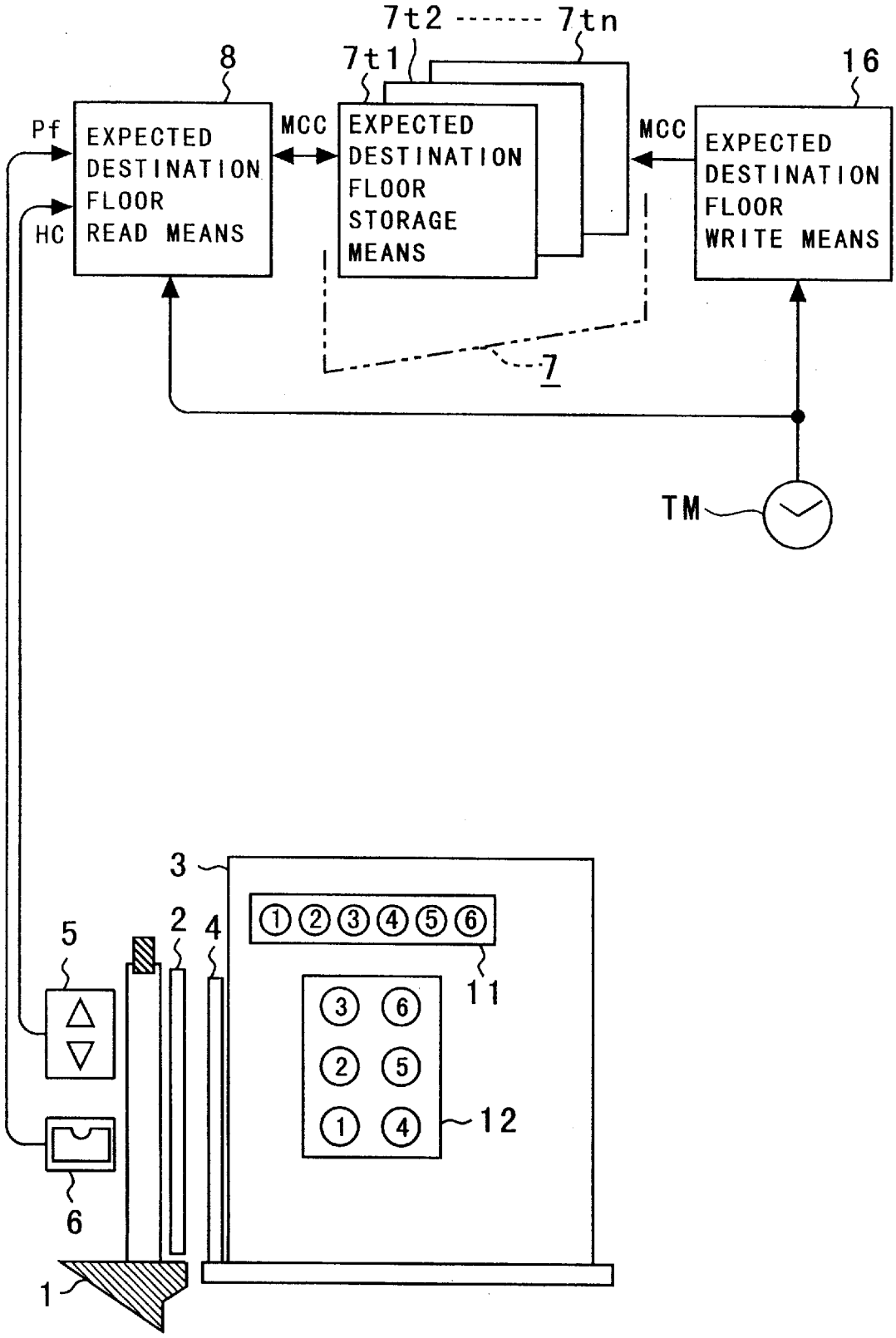
FIG. 13 shows a block diagram of a schematic structure of an elevator call system according to the fourth embodiment of the present invention.

FIG. 13 shows an elevator call registration system in which expected destination floor storage means 7*t*1, 7*t*2 . . . 7*t*n are provided for respective time periods in order to cope with variations in the traffic line. One of the expected destination floor storage means 7*t*1, 7*t*2 to 7*t*n to be used for each time period is selected by means of a timer TM. After selection of the expected destination floor storage means, the system operates in the same manner as that of the first embodiment, and repetition of its explanation is omitted here.

According to the fourth embodiment, the expected destination floor MCC can be set for each time period, thereby enabling expectation to match the passenger's traffic line more accurately.

With regard to the time period, there can be considered so many variation, such as the one on the basis of a one-day-cycle, and the one on the basis of a one-week-cycle, so that it is not necessarily easy to provide all kinds of complicated variations beforehand. Accordingly, the expected destination floor storage means may be provided for certain predetermined time periods; and in a case where the passenger uses the elevator at a time which does not belong to any of the time periods, there may be used the expected destination storage means 7*t*1, 7*t*2 to 7*t*n which is for the time period closest to the time period.

As has been described above, the elevator call registration system according to the present invention yields the following advantageous results.

The first aspect of the present invention is directed to an elevator call registration system which anticipates a destination floor for each passenger of the elevator in association with a departing floor, stores the thus-expected destination floor in expected destination floor storage means as an expected destination floor, identifies the passenger through use of passenger identification means provided in an elevator hall when the elevator is in actual operation, reads the expected destination floor on the basis of the result of such identification, temporarily indicates the expected destination floor for convenience of checking and automatically registers the expected destination floor with a control panel of the elevator as the final destination floor, and if an actual destination floor is different from the expected destination floor, register the actual destination floor which is newly designated through use of a car destination button as the final destination floor.

Therefore, in addition to the crime prevention function inherent to personal identification, automatic registration of a destination floor can be achieved. If the automatically-registered destination floor is different from an intended floor, the destination can be corrected by means of the car destination button.

The second aspect of the present invention is directed to an elevator call registration system which has passenger identification means provided in a car, reads an expected destination floor from a resultant identification signal and the floor where the car is located, indicates the expected destination floor in the car for a purpose of checking, and registers the expected destination floor in the control panel of the elevator as the final destination floor after the checking.

Even this invention enables automatic registration of a destination floor and correction of the registered destination floor. Further, since the identification means is provided in the car, the elevator call registration system becomes less expensive than that in which the identification means is provided on each floor. Further, the labor required for maintenance of the system can be reduced.

The third aspect of the present invention is characterized by the feature that an expected destination floor is read from a floor the car is located at and an identification signal issued as a result of actuation of the identification means while the car is open at the floor.

In a case where the passenger identification means is provided in the car, the passenger is inevitably required to actuate the identification means after entering the car, thus ensuring accuracy actuation of the identification means.

The fourth aspect of the present invention is characterized by the feature that, in a case where the passenger identification means is actuated from the time the car door starts opening at one floor to the time when the car ascends or descends from the floor, an expected destination floor is read from the identification signal and the floor. The system enables effective actuation of the passenger identification means for long time period.

The fifth aspect of the present invention is characterized by storing in expected destination floor storage means, as a series of data sets, the identification signal issued from the passenger identification means, the floor on which the passenger identification means is actuated, and an expected destination floor previously determined so as to correspond to the identification signal and the floor. The system enables to freely set the range of passengers and the departure floor to be used in setting an expected destination floor by virtue of configuration of the series of data sets. As a result, use of the elevator may be restricted so as to ensure crime prevention. Further, the elevator may be used while placing special emphasis on the functional aspect of automatic registration of a destination floor.

The sixth aspect of the present invention is characterized by storing in expected destination floor storage means, as a series of data sets, the identification signal, issued from the passenger identification means, the time period in which the passenger identification means is actuated and the corresponding floor, and an expected destination floor previously determined so as to correspond to the identification signal, the time period, and the floor.

The system enables setting of an expected destination floor matching the passenger's intention even when his traffic line differs from one time period to another.

The seventh aspect of the present invention is characterized by reading a corresponding expected destination floor from the identification signal, the floor in which the identification signal is generated, and the time period during which the passenger identification means is actuated, and by reading an expected destination floor corresponding to the closest time period if the expected destination floor is not stored in the expected destination floor storage means.

The system enables to reduce the labor required to set an expected destination floor.

The eighth aspect of the present invention is characterized by the feature that the destination floor can be designated by means of the car destination button during a predetermined period of time in which an expected destination floor is indicated or that if the expected destination floor cannot be read, the destination floor can be designated by means of the car destination button within a predetermined period of time from when it is found that the expected destination floor cannot be read.

According to the system, the operations required to correct the expected destination floor and those required to set a destination floor when the expected destination floor cannot be read become equal to those required in the conventional elevator call registration system. Consequently, it is possible for a visitor, in particular, to utilize the elevator without involving a sense of incongruity.

The ninth aspect of the present invention is characterized by the feature that the destination floor can be registered in the control panel of the elevator only when there is a match between the result of identification of the passenger and the identification result stored beforehand. According to the system, only those who have special permission can utilize the elevator, thus yielding the advantage of crime prevention.

The tenth aspect of the present invention is characterized by the feature that a destination floor is allowed to be registered in the control panel in preference to the expected destination floor, by means of the car destination button provided in the car allocated to the floor from which the identification signal is issued. As a result, even when a plurality of elevators are located at a single floor, only the car called by the identified passenger, i.e., the car which the identified passenger is to enter can allow the passenger to change the expected destination floor and to register the thus-corrected destination floor in the control panel. Accordingly, the same destination floor is not wastefully registered into the plurality of elevators.

The eleventh aspect of the present invention is characterized by illuminating an answer light in different manner according to whether an indicated floor is an expected destination floor or a destination floor. As a result, it becomes easy for the passenger to become aware of whether he can still correct the expected destination floor or he cannot correct it after the expected destination floor has been determined as a destination floor.

The twelfth aspect of the present invention is characterized by causing the answer light to blink when an indicated floor is an expected destination floor and to illuminate without blinking when the indicated floor is a destination floor. As a result, the passenger can readily become aware of whether or not he can correct the destination floor.

The thirteenth aspect of the present invention is characterized by the passenger identification means being arranged so as to issue an identification signal only for the registered passenger. The system enables to limit use of the elevator to specific persons having permission.

The fourteenth aspect of the present invention is characterized by a fingerprint detector being used as the passenger identification means. According to the system, there is no significant difference between actuation of an elevator button and actuation of the fingerprint detector, thus providing the passenger with operations without involving a sense of incongruity.

The fifteenth aspect of the present invention is characterized by the feature that when a destination floor is designated by means of the car destination button, the destination floor is registered as another new expected destination floor. According to the system, the expected destination floor storage means is automatically corrected through operations similar to those required for the existing elevator call registration system. The present invention yields the advantage of being able to flexibly follow variations in the expected destination floor with time.

Further, the present invention is not limited to these embodiments, but variations and modifications may be made without departing from the scope of the present invention.

What is claimed is:

1. An elevator call registration system comprising:

passenger identification means which is provided in an elevator hall and identifies a passenger;

expected destination floor storage means for storing, as an expected destination floor of the passenger, a floor which is previously determined so as to correspond to both of the identification signal and the floor where the passenger identification means is provided;

expected destination floor read means which reads the expected destination floor from the expected destination floor storage means when the passenger identification means issues the identification signal;

an answer light which indicates the thus-read expected destination floor in the car;

time-limit means which registers the expected destination floor in a control panel of the elevator as a destination floor of the passenger after having the answer light indicate the expected destination floor for a predetermined period of time; and a car destination button which is provided in the car and registers, as the destination floor of the passenger, a floor newly designated through actuation within the predetermined period of time, in preference to the expected destination floor.

2. An elevator call registration system comprising:

passenger identification means which is provided in an elevator car and identifies a passenger;

expected destination floor storage means which stores, as an expected destination floor of the passenger, a floor which is previously determined so as to corresponding to both of an identification signal issued from the passenger identification means and a floor where the car is located in response to the actuation of the passenger identification means;

expected destination floor read means which reads from the expected destination floor storage means the expected destination floor corresponding to both of the identification signal and the floor where the car is located, when the passenger identification means issues the identification signal;

an answer light which indicates the thus-read expected destination floor in the car;

time-limit means which registers the expected destination floor in a control panel of the elevator as a destination floor of the passenger after having the answer light indicate the expected destination floor for a predetermined period of time; and a car destination button which is provided in the car and registers, as the destination floor of the passenger, a floor newly designated through actuation within the predetermined period of time.

3. The elevator call registration system as defined in claim 2, wherein the expected destination floor read means reads an expected destination floor based on both of the identification signal issued as a result of actuation of the identification means while the elevator is open at a certain floor and the floor.

4. The elevator call registration system as defined in claim 2, wherein the expected destination floor read means reads an expected destination floor based on both of the identification signal issued as a result of actuation of the identification means from the time the car door starts opening at one floor to the time the car ascends or descends from the floor and the floor.

5. The elevator call registration system as defined in claim 1, wherein the expected destination floor storage means stores, as a series of data sets, the identification signal issued from the passenger identification means, the floor on which the passenger identification means is actuated, and an expected destination floor previously determined so as to correspond to the identification signal and the floor.

6. The elevator call registration system as defined in claim 1, wherein:

the expected destination floor storage means stores, as a series of data sets, the identification signal issued from the passenger identification means, the floor on which the passenger identification means is actuated, the time period during which the passenger identification means is actuated, and an expected destination floor previously determined so as to correspond to all of the identification signal, the floor, and the time period; and wherein the expected destination floor read means reads a corresponding expected destination floor based on the identification signal, the floor, and the time period.

7. The elevator call registration system as defined in claim 1, wherein:

the expected destination floor storage means stores, as a series of data sets, the identification signal issued from the passenger identification means, the floor on which the passenger identification means is actuated, the time period during which the passenger identification means is actuated, and an expected destination floor previously determined so as to correspond to all of the identification signal, the floor, and the time period; and; and wherein the expected destination floor read means reads a corresponding expected destination floor based on the identification signal and the time period during which the identification signal is issued and, if the expected destination floor corresponding to the time period is not stored in the expected destination floor storage means, reads an expected destination floor corresponding to a time period closest to the time period.

8. The elevator call registration system as defined in claim 1, wherein the time-limit means registers in the control panel of the elevator, as the destination floor of the passenger, the expected destination floor of the passenger, when the expected destination floor has been indicated in the car for a predetermined period of time after reading of the expected destination floor and neither indicates nor registers the expected destination floor if the expected destination floor cannot be read; and wherein the car destination button is provided in the car and registers in the control panel, as the destination floor of the passenger, a floor newly designated through actuation within the predetermined period of time or within a predetermined period of time after it has been found that the expected destination floor cannot be read, in preference to the expected destination floor.

9. The elevator call registration system as defined in claim 1, wherein the time-limit means registers in the control panel of the elevator, as the destination floor of the passenger, the expected destination floor of the passenger, when the expected destination floor has been indicated in the car for a predetermined period of time after reading of the expected destination floor and neither indicates nor registers the expected destination floor if the expected destination floor cannot be read; and wherein the car destination button registers in the control panel, as the destination floor of the passenger, a floor newly designated through actuation within the predetermined period of time in preference to the expected destination floor and does not register the destination floor if the expected destination floor cannot be read for reasons due to the identification signal.

10. The elevator call registration system as defined in claim 1, wherein the car destination button is provided in the car allocated to the floor from which the identification signal is issued.

11. The elevator call registration system as defined in claim 1, wherein the answer light is illuminated in different manners according to whether an indicated floor is an expected destination floor or a destination floor.

12. The elevator call registration system as defined in claim 11, wherein the answer light is caused to blink when an indicated floor is an expected destination floor and to illuminate without blinking when the indicated floor is a destination floor.

13. The elevator call registration system as defined in claim 1, wherein the passenger identification means is arranged so as to issue an identification signal only for the registered passenger.

14. The elevator call registration system as defined in claim 1, wherein a fingerprint detector is used as the passenger identification means.

15. The elevator call registration system as defined in claim 1, further comprising expected destination write means which writes the destination floor designated through actuation of the car destination button into the expected destination storage means as a newly expected destination floor.

16. The elevator call registration system as defined in claim 2, wherein the expected destination floor storage means stores, as a series of data sets, the identification signal issued from the passenger identification means, the floor on which the passenger identification means is actuated, and an expected destination floor previously determined so as to correspond to the identification signal and the floor.

17. The elevator call registration system as defined in claim 2, wherein:

the expected destination floor storage means stores, as a series of data sets, the identification signal issued from the passenger identification means, the floor on which the passenger identification means is actuated, the time period during which the passenger identification means is actuated, and an expected destination floor previously determined so as to correspond to all of the identification signal, the floor, and the time period; and wherein the expected destination floor read means reads a corresponding expected destination floor based on the identification signal, the floor, and the time period.

18. The elevator call registration system as defined in claim 2, wherein:

the expected destination floor storage means stores, as a series of data sets, the identification signal issued from the passenger identification means, the floor on which the passenger identification means is actuated, the time period during which the passenger identification means is actuated, and an expected destination floor previously determined so as to correspond to all of the identification signal, the floor, and the time period; and; and wherein the expected destination floor read means reads a corresponding expected destination floor based on the identification signal and the time period during which the identification signal is issued and, if the expected destination floor corresponding to the time period is not stored in the expected destination floor storage means, reads an expected destination floor corresponding to a time period closest to the time period.

19. The elevator call registration system as defined in claim 2, wherein the time-limit means registers in the control panel of the elevator, as the destination floor of the passenger, the expected destination floor of the passenger, when the expected destination floor has been indicated in the car for a predetermined period of time after reading of the expected destination floor and neither indicates nor registers the expected destination floor if the expected destination floor cannot be read; and wherein the car destination button is provided in the car and registers in the control panel, as the destination floor of the passenger, a floor newly designated through actuation within the predetermined period of time or within a predetermined period of time after it has been found that the expected destination floor cannot be read, in preference to the expected destination floor.

20. The elevator call registration system as defined in claim 2, wherein the time-limit means registers in the control panel of the elevator, as the destination floor of the passenger, the expected destination floor of the passenger, when the expected destination floor has been indicated in the car for a predetermined period of time after reading of the expected destination floor and neither indicates nor registers the expected destination floor if the expected destination floor cannot be read; and wherein the car destination button registers in the control panel, as the destination floor of the passenger, a floor newly designated through actuation within the predetermined period of time in preference to the expected destination floor and does not register the destination floor if the expected destination floor cannot be read for reasons due to the identification signal.

* * * * *